US009780483B1

(12) United States Patent
Goulbourne

(10) Patent No.: US 9,780,483 B1
(45) Date of Patent: Oct. 3, 2017

(54) MODULAR STRAIN RELIEF ASSEMBLY

(71) Applicant: Wesley Astor Goulbourne, Prospect Park, PA (US)

(72) Inventor: Wesley Astor Goulbourne, Prospect Park, PA (US)

( * ) Notice: Subject to any disclaimer, the term of this patent is extended or adjusted under 35 U.S.C. 154(b) by 0 days.

(21) Appl. No.: 15/499,458

(22) Filed: Apr. 27, 2017

(51) Int. Cl.

| | |
|---|---|
| ***H01R 13/58*** | (2006.01) |
| ***H01R 13/56*** | (2006.01) |
| ***H01R 13/516*** | (2006.01) |
| ***H01R 13/502*** | (2006.01) |
| ***H01R 43/20*** | (2006.01) |

(52) U.S. Cl.
CPC ..... *H01R 13/562* (2013.01); *H01R 13/502* (2013.01); *H01R 13/516* (2013.01); *H01R 43/20* (2013.01)

(58) Field of Classification Search
CPC ..... H01R 13/5812; H01R 13/501; H01R 13/506; H01R 13/595; H01R 13/59; H01R 13/5808
USPC ..... 439/470, 467, 466, 465, 473, 461, 462, 439/455, 453
See application file for complete search history.

(56) References Cited

U.S. PATENT DOCUMENTS

| | | | | |
|---|---|---|---|---|
| 4,988,311 A * | 1/1991 | Tanzola | ..... | H01R 4/2433 439/389 |
| 5,967,830 A * | 10/1999 | Tsuji | ..... | H01R 13/506 439/467 |
| 6,196,865 B1 * | 3/2001 | Ruffel | ..... | H01R 13/56 439/470 |
| 9,444,180 B2 * | 9/2016 | Goulbourne | ..... | H01R 13/5841 |

* cited by examiner

*Primary Examiner* — Phuong Chi T Nguyen

(57) ABSTRACT

The present disclosure discloses a modular strain relief assembly and a method for providing strain relief for the junction of an electrical cable and an electrical connector. The strain relief assembly comprises a connector adapter, a cable adapter and a ball-joint connector. Each of the connector adapter, the cable adapter and the ball-joint connector comprises a first section and a second section. The first section of each of the connector adapter, the cable adapter and the ball-joint connector comprises pins. The second section of each of the connector adapter, the cable adapter and the ball-joint connector comprises sockets. The pins are allowed to mate with the sockets to join the first section and second section of each of the connector adapter, the cable adapter and the ball-joint connector, respectively.

11 Claims, 14 Drawing Sheets

MODULAR STRAIN RELIEF ASSEMBLY

FIELD OF INVENTION

The present disclosure generally relates to cable connectors for protecting electrical cables at cable-connector junctions and, more particularly, to a connector strain relief assembly adapted for use at such cable-connector junctions.

BACKGROUND

As known, cables have been used for communication and power. For example, the cables are used to charge electronic devices. In another example, the cables are used for communication such as speaking on phone using headphones in order to not use hands. Further, the cables are used to listen to music via an electronic device or any other musical instrument. Use of cables may enable people to continue working and playing.

Conventional electrical cable assemblies have developed a reputation for breaking and/or failing in use. The primary causes for such breakages are lack of any strain relief components, or the use of ineffective strain relief designs. In some of prior art designs, cloth or braided cable coverings, rubber or even machined metal junctions are provided to cover the cable. However, they do not resist tangling of the cables completely.

Therefore, there is a need for an improved strain relief system that allows an electrical cable to move naturally, but which functions to prevent the occurrence of harsh bends at the cable/connector junction.

BRIEF SUMMARY

The above-mentioned problems are addressed by providing a connector strain relief assembly suitable for placement over the junction of an electrical cable and an attached electrical connector.

In one aspect of the present disclosure, a connector strain relief assembly suitable for placement over a junction of an electrical cable and an attached electrical connector is disclosed. The strain relief assembly comprises a connector adapter, a cable adapter and a ball-joint connector. The connector adapter comprises a first connector adapter end configured to fit over the electrical connector and a second connector adapter end, a portion of a surface of the second connector adapter end having a substantially spherical shape. The cable adapter comprises a first cable adapter end configured to fit over the electrical cable, and a second cable adapter end, a portion of a surface of the second cable adapter end having a substantially spherical shape. The ball-joint connector comprises a ball-joint link, which in turn comprises a link ball end. The link ball end is rotatably attached to the second connector adapter end, and a link socket end. The link socket end is rotatably attached to the second cable adapter end. Further, each of the connector adapter, the cable adapter and the ball-joint connector comprises a first section and a second section. The first section of each of the connector adapter, the cable adapter and the ball-joint connector comprises pins. The second section of each of the connector adapter, the cable adapter and the ball-joint connector comprises sockets. The pins are allowed to mate with the sockets to join the first section and second section of each of the connector adapter, the cable adapter and the ball-joint connector, respectively.

In another aspect of the present disclosure, the connector strain relief assembly comprises a docking tool to release the pins from the sockets.

In yet another aspect of the present disclosure, a method for providing strain relief for the junction of an electrical cable and an electrical connector is also disclosed.

The features and advantages described in this summary and in the following detailed description are not all-inclusive, and particularly, many additional features and advantages will be apparent to one of ordinary skill in the relevant art, in view of the drawings, and specification thereof. Moreover, it should be noted that the language used in the specification has been principally selected for readability and instructional purposes, and may not have been selected to delineate or circumscribe the inventive subject matter.

BRIEF DESCRIPTION OF DRAWINGS

In the following drawings, like reference numbers are used to refer to like elements. Although the following figures depict various examples of the invention, the invention is not limited to the examples depicted in the figures.

DETAILED DESCRIPTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a connector strain relief assembly and a method for providing strain relief for the junction of an electrical cable and an electrical connector. The strain relief assembly comprises a connector adapter, a cable adapter and a ball-joint connector. Each of the connector adapter, the cable adapter and the ball-joint connector comprises a first section and a second section. The first section of each of the connector adapter, the cable adapter and the ball-joint connector comprises pins. The second section of each of the connector adapter, the cable adapter and the ball-joint connector comprises sockets. The pins are allowed to mate with the sockets to join the first section and second section of each of the connector adapter, the cable adapter and the ball-joint connector, respectively.

The connector strain relief assembly comprises a tool to release the pins from the sockets. Each of the connector adapter, the cable adapter and the ball-joint connector are moveable segments over an electrical cable and provide strain relief cable breakage at the connector. The various features and embodiments of the connector strain relief assembly are explained in conjunction with the description of FIGS. 1-12.

It should be understood that the present disclosure is presented as an improvement over US granted patent U.S. Pat. No. 9,444,180 assigned to the same Inventor.

Figure 1:
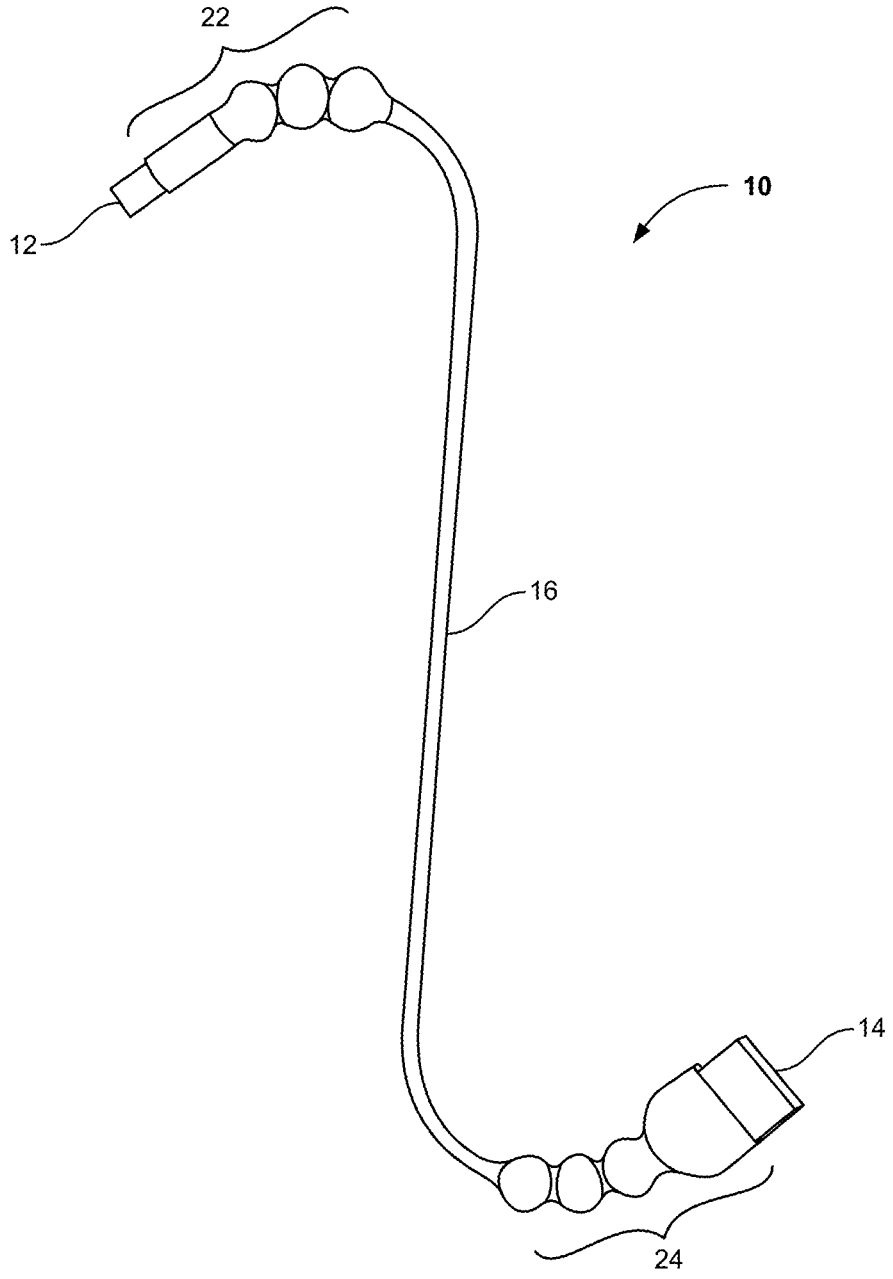
FIG. 1 illustrates an electrical cable assembly including strain relief assemblies at cable-connector junctions, in accordance with one embodiment of the present disclosure.

Now referring to FIG. 1, an electrical cable assembly 10 is shown, in accordance with the present disclosure. The electrical cable assembly 10 includes a first electrical connector 12 electrically connected to a second electrical connector 14 by means of an electrical cable 16, as is well known in the art. The electrical cable 16 may include a plurality of electrical conductors suitable for data and power transmission between the electrical connectors 12, 14, for example. In the particular embodiment shown, the first electrical connector 12 is configured as a nine-pin cell phone male connector and the second electrical connector 14 is configured as a USB male connector. It should be understood that any type of male or female electrical connector might be used at an end of the electrical cable assembly 10. It should further be understood that the electrical cable may be singly or multiply branched, and that more than two electrical connectors may be included in an electrical cable assembly (not shown).

The electrical cable assembly 10 may further include: (i) a first strain relief assembly 22 disposed over a portion of the electrical cable 16 and the first electrical connector 12, and (ii) a second strain relief assembly 24 disposed over a portion of the electrical cable 16 and the second electrical connector 14. It can be appreciated by one skilled in the art that the electrical cable assembly 10 can be adapted for protection of an electrical cable connector in other applications, such as plugs for laptop computers and other consumer electronics such as audio headphones, at a 3.5 mm jack section, for example. The electrical cable assembly 10 can also be adapted for use with cell phone chargers and various types of data cables. Although the strain relief assemblies 22, 24 are shown as black or dark grey in color, the strain relief assemblies 22, 24 may be provided in any of a variety of colors, and may match or contrast with the color of the electrical cable 16.

Figure 2:
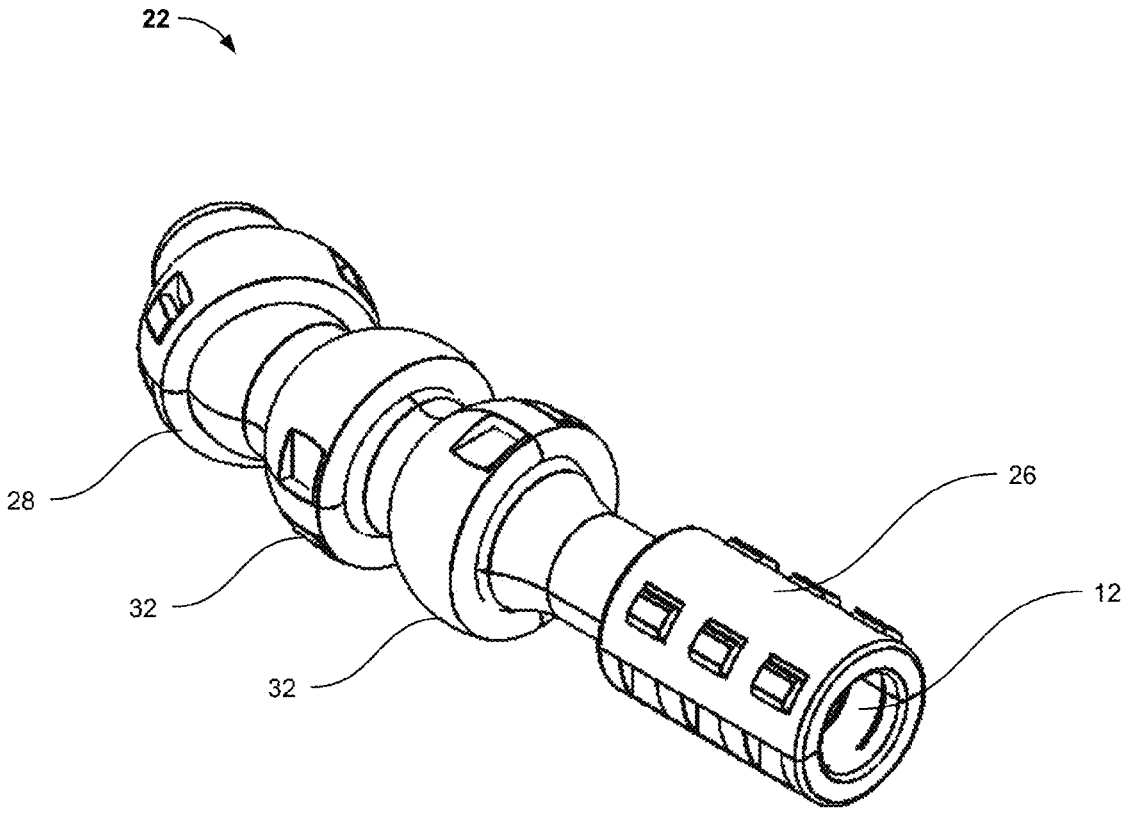
FIG. 2 illustrates a first strain relief assembly, in accordance with one embodiment of the present disclosure.

Referring to FIG. 2, a detailed view of the strain relief assembly 22 is shown, in accordance with one embodiment of the present disclosure. As can be seen from the FIG. 2, the first electrical connector 12 comprises a connector adapter 26. Further, the connector adapter 26 is rotatably attached to a ball-joint link 32. It should be understood that one or more ball-joint links 32 might be attached in a series to form a ball-joint connector 32, as shown in FIG. 2.

Further, the ball-joint link or connector 32 may be rotatably connected with a cable adapter 28. The connector adapter 26, the one or more ball-joint links 32, and the cable adapter 28 form a hollow configuration to allow the electrical cable 16 to pass completely through the strain relief assembly 22, from the cable adapter 28 to the first electrical connector 12, for mechanical and electrical attachment to the first electrical connector 12.

It can be appreciated by one skilled in the art that an exemplary embodiment of a strain relief assembly (not shown) may comprise: (i) a connector adapter having a socket end, (ii) a ball-joint connector in reversed orientation from that shown in FIG. 2, and (iii) a cable adapter having a ball end. In addition, the ball-joint connector may comprise: (i) only a single ball-joint link 32 (i.e., without the optional second ball-joint link 32 for applications in which space may be limited, or (ii) three or more ball-joint links 32 where available space may be convoluted.

Figure 3:
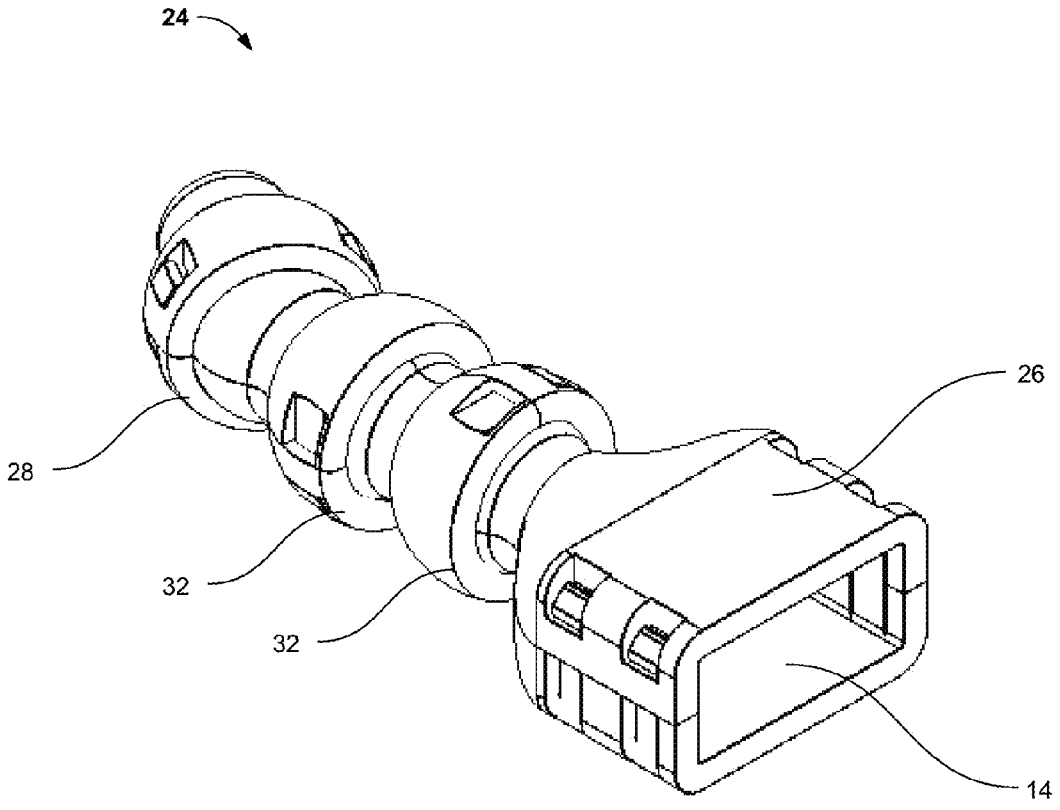
FIG. 3 illustrates a second strain relief assembly, in accordance with one embodiment of the present disclosure.

Now referring to FIG. 3, a detailed view of the strain relief assembly 24 is shown, in accordance with one embodiment of the present disclosure. The second electrical connector 14 may be snapped over a connector adapter 26. The connector adapter 26 is rotatably coupled to a second ball-joint link 32. As explained above, the second ball-joint link 32 may further comprise additional second ball-joint links 32 rotatably coupled to the second ball-joint link 32, the one or more second ball-joint links 32 helps to extend and enhance the strain relief function. Further, the second ball-joint link 32 is rotatably coupled to a cable adapter 28. The connector adapter 26 is hollow to allow the electrical cable 16 to pass through the strain relief assembly 24, for mechanical and electrical attachment to the second electrical connector 14.

Figure 4:
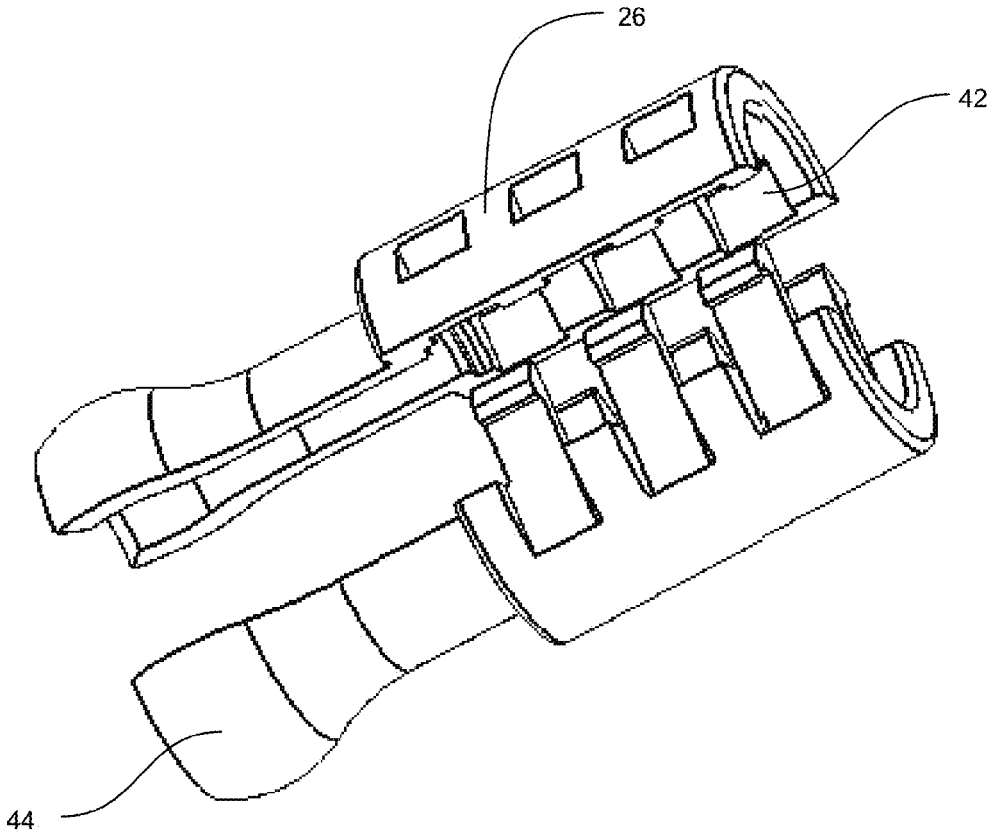
FIG. 4 illustrates a connector adapter in the strain relief assembly, in accordance with one embodiment of the present disclosure.

Further, referring to FIG. 4, constructional features of the connector adapter 26 is explained, in accordance with one embodiment of the present disclosure. The connector adapter 26 includes a connector end 42, sized and generally cylindrically-shaped so as to fit over the first electrical connector 12. The connector end 42 has a length selected to frictionally retain the connector end 42 on the first electrical connector 12, while allowing the first electrical connector 12 to be mated with a connector on an external device without interference from the connector end 42. The connector adapter 26 also includes a ball end 44, sized and spherically shaped for rotatable attachment into the ball-joint link 32. In accordance with the present disclosure, the approximate geometry of a bearing surface on the connector adapter 26 that generally remains in contact with an inner surface of the hollow ball-joint link 32.

Figure 5:
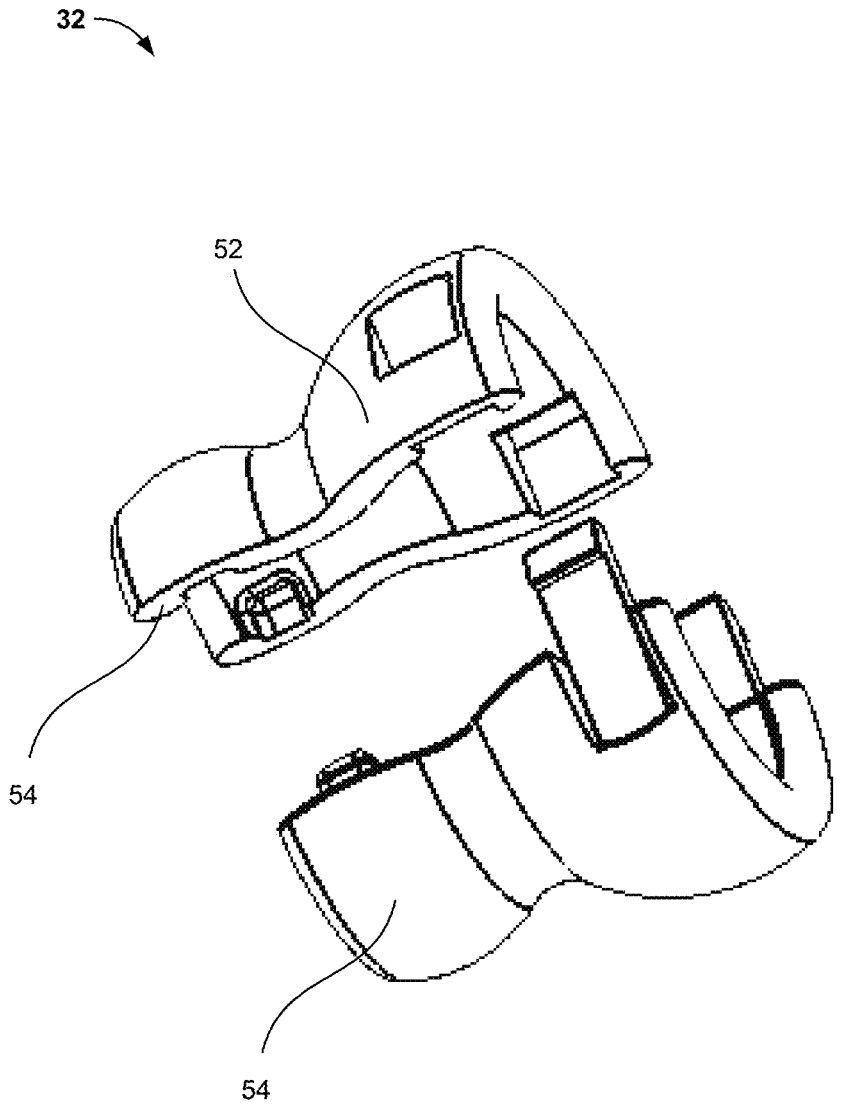
FIG. 5 illustrates a ball-socket link or connector in the strain relief assembly, in accordance with one embodiment of the present disclosure.

Further, referring to FIG. 5, constructional features of the ball-joint link 32 is explained, in accordance with one embodiment of the present disclosure. The ball-joint link 32 includes a socket end 52, sized and generally spherically-shaped for rotatable attachment over the ball end 44 of the electrical connector 12. The ball-joint link 32 also includes a ball end 54, sized and spherically shaped for rotatable attachment into the socket end 52 of an adjacent ball-joint link 32 (not shown). It can be appreciated by one skilled in the art that the socket end 52 of the ball-joint link 32 is also sized and generally spherically-shaped for rotatable attachment over the ball end 54 of an adjacent ball-joint link 32. In accordance with the present invention, the approximate geometry of a bearing surface on the ball-joint link 32 that generally conforms to and remains in contact with the inner surface of the hollow ball-joint link 32.

Figure 6:
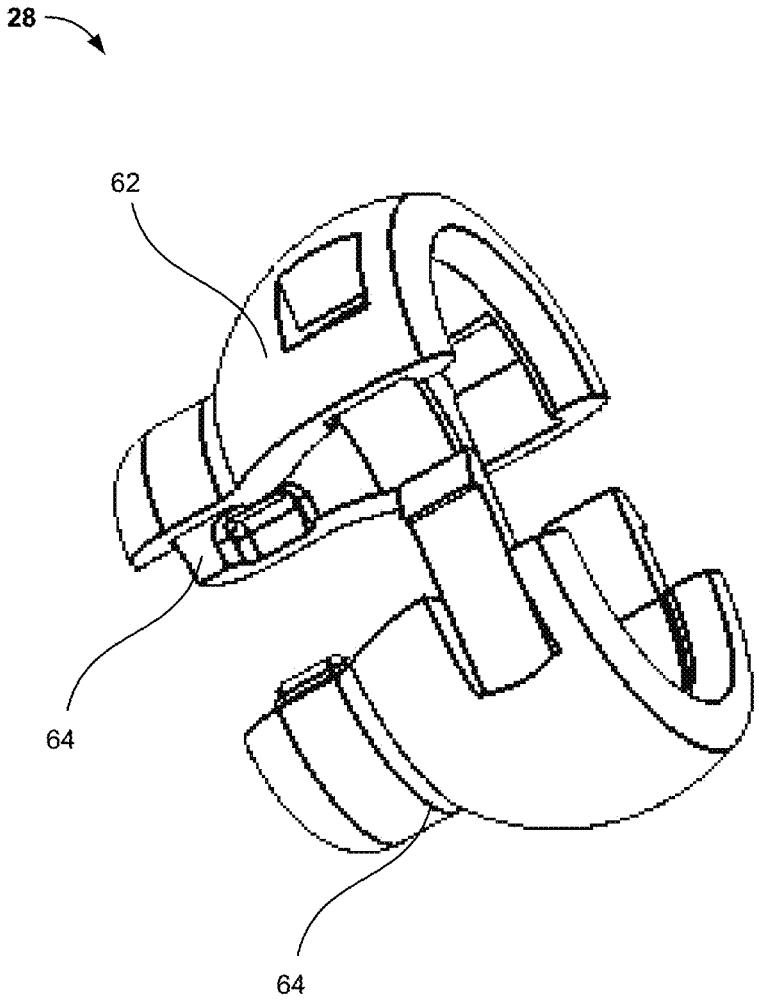
FIG. 6 illustrates a cable adapter in the strain relief assembly, in accordance with one embodiment of the present disclosure.

Furthermore, referring to FIG. 6, constructional features of the cable adapter 28 is explained, in accordance with one embodiment of the present disclosure. The cable adapter 28 includes a socket end 62, sized and generally spherically-shaped for rotatable attachment over the ball end 54 of an adjacent ball-joint link 32. The interior surface of the socket end 62 generally conforms to and remains in contact with the bearing surface of the ball end 54 of the hollow ball-joint link 32. The cable adapter 28 also includes a cable end 64, sized and generally spherically-shaped for frictional attachment onto the electrical cable 16.

Figure 7:
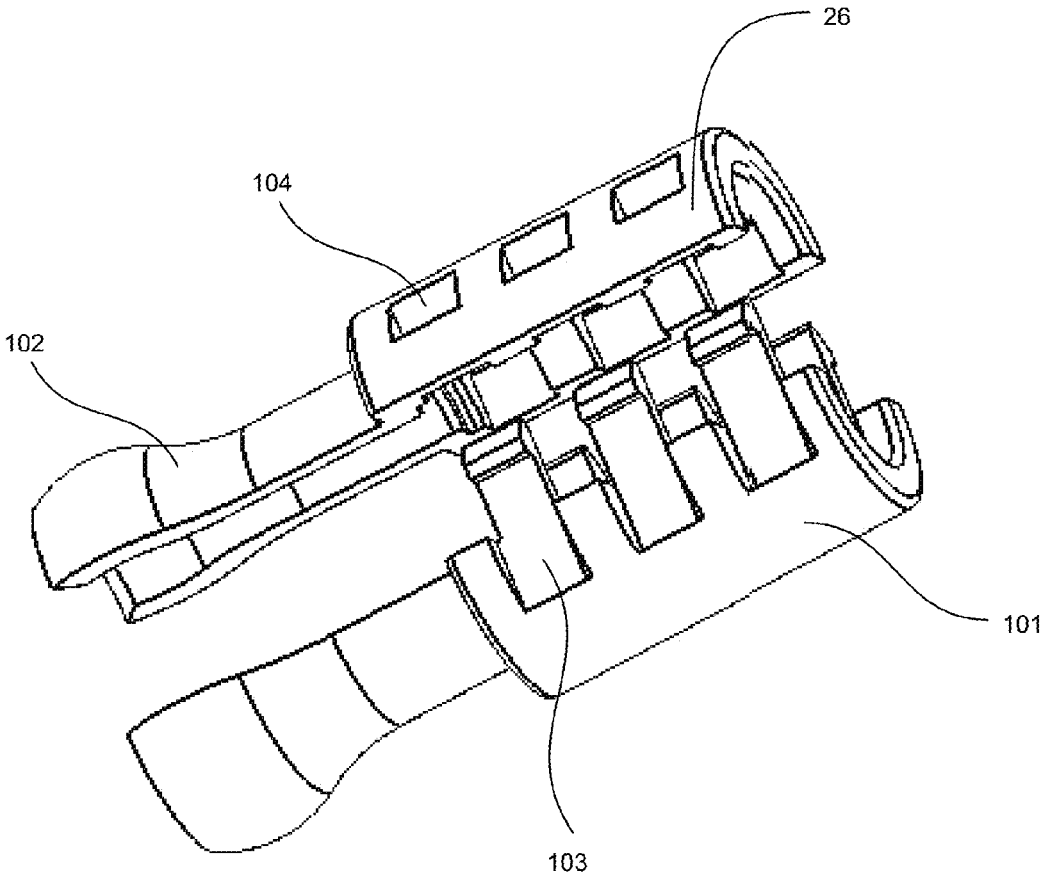
FIG. 7 illustrates the connector adapter comprising pins and sockets, in accordance with one embodiment of the present disclosure.
Figure 8:
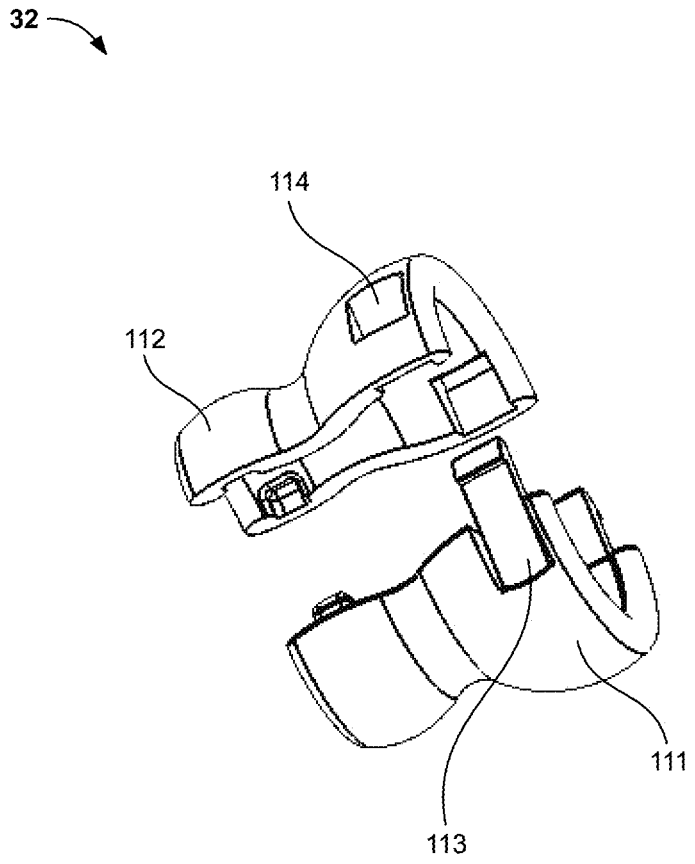
FIG. 8 illustrates the ball-socket link or connector comprising pins and sockets, in accordance with one embodiment of the present disclosure.
Figure 9:
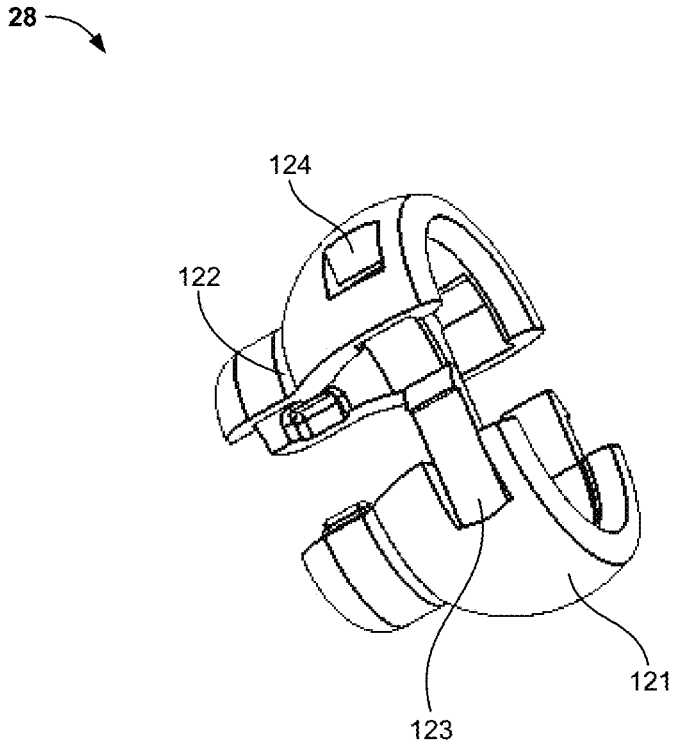
FIG. 9 illustrates the cable adapter comprising pins and sockets, in accordance with one embodiment of the present disclosure.

Now referring to FIGS. 7-9, the novel features of the present disclosure is explained in accordance with one embodiment of the present disclosure. Referring to FIG. 7, the connector adapter 26 comprising a first connector adapter section 101 and a second connector adapter section 102 is shown. The first connector adapter section 101 comprises pins 103 as shown in FIG. 7. Further, the second connector adapter section 102 comprises sockets or holes 104 as shown in FIG. 7. In other words, the first connector adapter section 101 comprises male members 103 and the second connector adapter section 102 comprises female members 104, which may be used to mate in order to create a joint unit i.e., the connector adapter 26.

Similarly, the ball-joint link or connector 32 comprises a first ball-joint connector section 111 and a second ball-joint connector section 112. The first ball-joint connector section 111 comprises pins 113 as shown in FIG. 8. Further, the second ball-joint connector section 112 comprises sockets or holes 114 as shown in FIG. 8. In other words, the first ball-joint connector section 111 comprises male members 113 and the second ball-joint connector section 112 comprises female members 114, which may be used to mate in order to create a joint unit i.e., the ball-joint link or connector 32.

Similarly, the cable adapter 28 comprises a first cable adapter section 121 and a second cable adapter section 122. The cable adapter section 121 comprises pins 123 as shown in FIG. 9. Further, the second cable adapter section 122 comprises sockets or holes 124 as shown in FIG. 9. In other words, the first cable adapter section 121 comprises male members 123 and the second cable adapter section 122 comprises female members 124, which may be used to mate in order to create a joint unit i.e., the cable adapter 28.

Figure 10A:
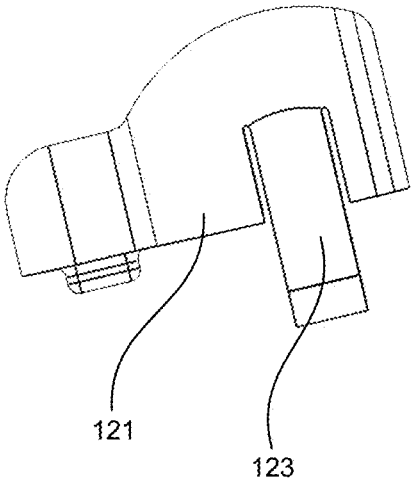
FIGS. 10A and 10B illustrate perspective views of the first cable adapter section comprising the pins, in accordance with one embodiment of the present disclosure.
Figure 10B:
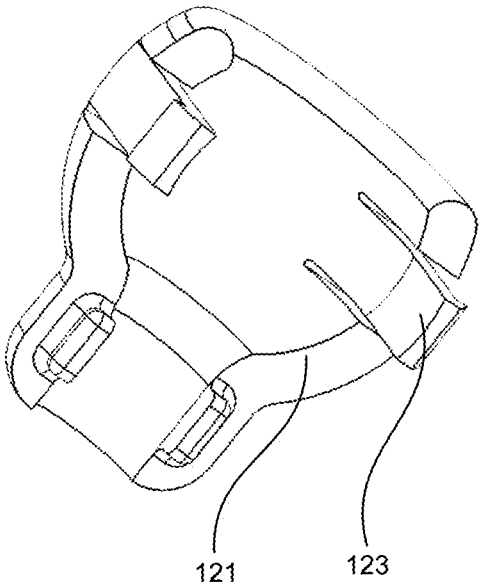
Figure 10C:
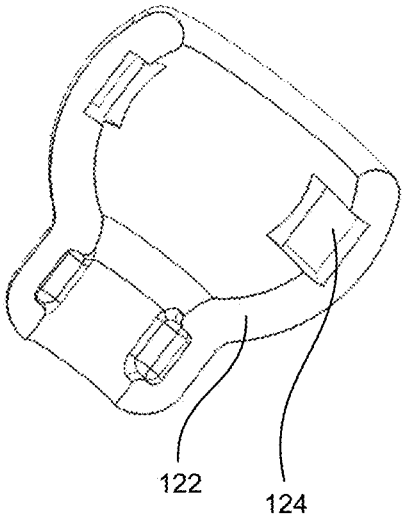
FIGS. 10C and 10D illustrate perspective views of the second cable adapter section comprising the sockets, in accordance with one embodiment of the present disclosure.
Figure 10D:
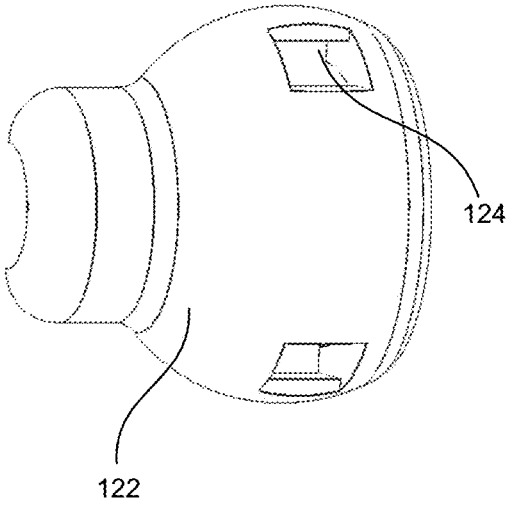
Figure 10E:
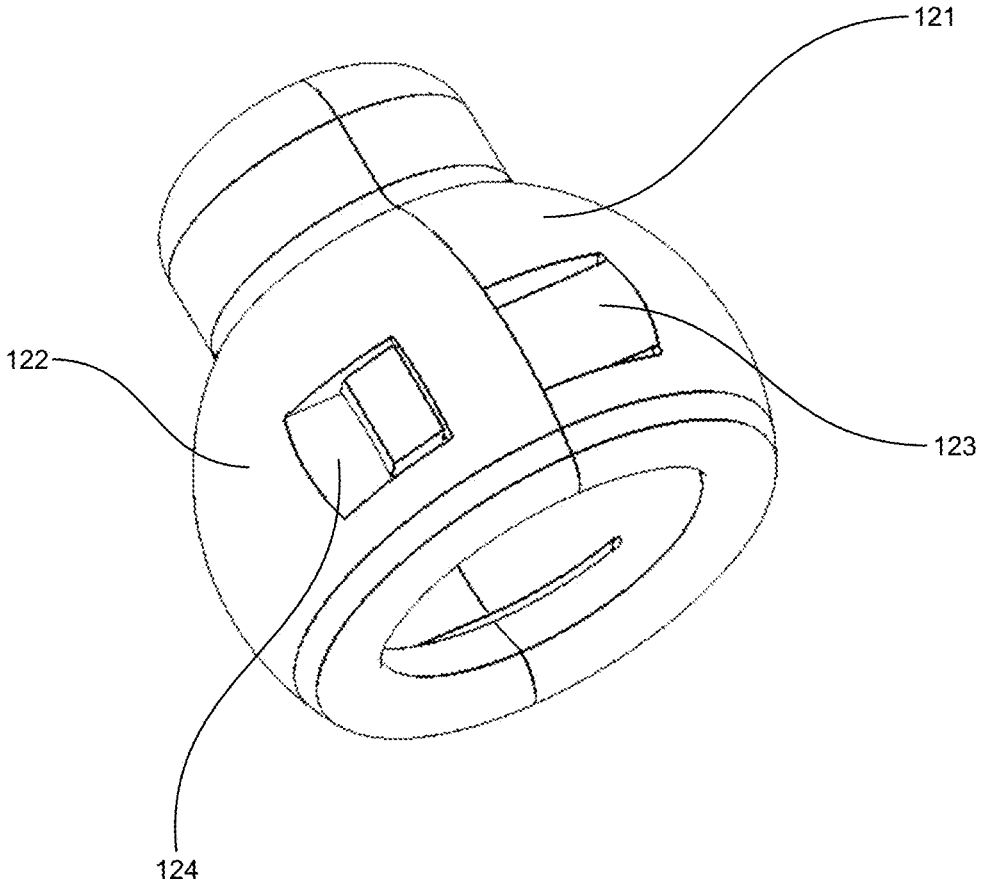
FIG. 10E illustrates perspective view of the cable adapter, in accordance with one embodiment of the present disclosure.

Now, referring to FIGS. 10A and 10B, perspective views of the first cable adapter section 121 comprising the pins 123 are shown. Similarly, referring to FIGS. 10C and 10D, perspective views of the second cable adapter section 122 comprising the sockets 124 is shown. Further, referring to FIG. 10E, perspective view of the cable adapter 28 is shown in which the first cable adapter section 121 comprising the male members 123 and the second cable adapter section 122 comprising the female members 124 mated to create a joint unit i.e., cable adapter 28.

It should be obvious to a person skilled in the art to use the description provided for the cable adapter 28 to create a joint unit of connector adapter 26 and ball-join connector 32.

Figure 11A:
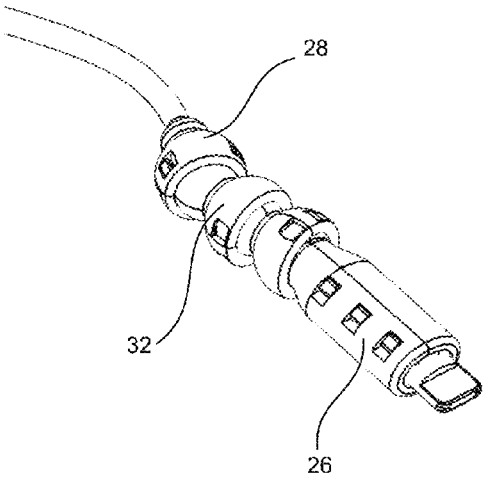
FIGS. 11A and 11B illustrates connector strain assembly coupled to the electrical cable, in accordance with one embodiment of the present disclosure.
Figure 11B:
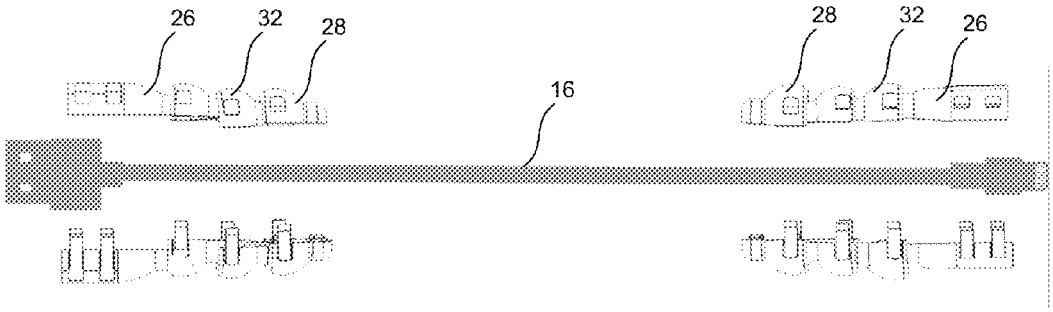

Referring to FIGS. 11A and 11B, the connector strain assembly 10 in use is shown. As can be seen from FIGS. 11A and 11B, the ball-joint link 32 is at a side-to-side movement relative to the connector adapter 26, and the cable adapter 28 is at a maximum side-to-side movement relative to the ball-joint link 32. Each of the connector adapters 26, the cable adapter 28 and the ball-joint link 32 comprises pins at one end and sockets at another end. At first, the ball-joint link 32 is coupled to the connector adapter 26 at a side-to-side movement relative to the connector adapter 26 over the electrical cable 16. Subsequently, the cable adapter 28 is coupled ball-joint link 32 at a side-to-side movement relative to the ball-joint link 32 over the electrical cable 16. After placing the connector adapter 26, the ball-joint link 32, the cable adapter 28 at side-to-side over the electrical cable 16, the pins on the connector adapter 26, the cable adapter 28 and the ball-joint link 32 are snapped to connect with the sockets provided on another side of the adapter 26, the cable adapter 28 and the ball-joint link 32, respectively. Consequently, the connector strain assembly 10 is provided over the electrical cable 16. Due to their respective constructional features, they can take the stress and resist tangling to a great extent.

Figure 12A:
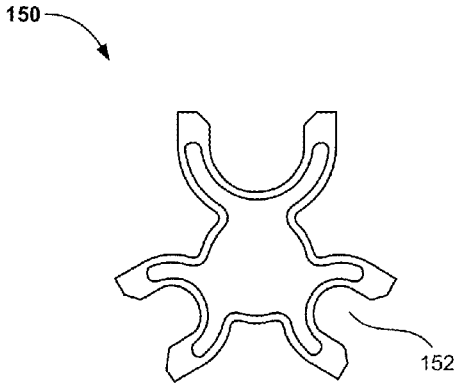
FIG. 12A illustrates a docking tool-comprising pin releasing docks, in accordance with one embodiment of the present disclosure.
Figure 12B:
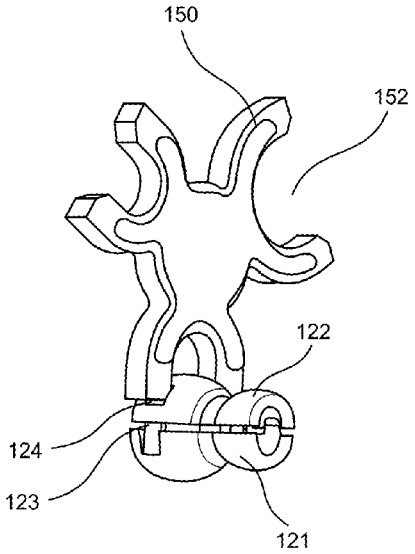
FIGS. 12B and 12C illustrate a perspective view and a front view, respectively of the docking-tool, showing the tool in operation.
Figure 12C:
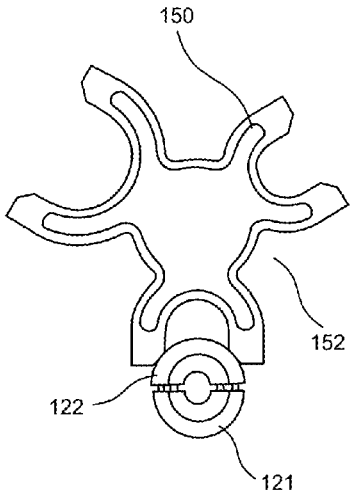

In one embodiment of the present disclosure, the connector strain relief assembly 10 may comprise a docking tool 150 as shown in FIG. 12A. The docking tool 150 may comprise pin release docks 152. The pin release docks 152 may be used as an external device to release the pins (e.g., pins 123) from the sockets (e.g., sockets 124). Further, as can be seen, FIGS. 12B and 12C show a perspective view and a front view, respectively, of the docking tool 150 in operation. Referring to FIGS. 12B and 12C, the pin release docks 152 are used to press down the pin/male member e.g., pins 123 into the sockets/female member e.g., socket 124 in order to release the pins 123 from sockets 124. Specifically, FIGS. 12B and 12C show the first cable adapter section 121 comprising the male members 123 and the second cable adapter section 122 comprising the female members 124. In order to lock the pins 123 with the sockets 124, a user may snap the pins 123 into the sockets 124 by hand. Subsequently, the user may use the docking tool 150 to release the pins 123 from the sockets 124 by pressing down the pins 123. Similarly, the docking tool 150 may be used to release the pins 123 from the sockets 124 of the connector adapter, and the ball-joint link.

In one example, the docking tool 150 may comprise three or more open wrench like docks that when used to apply pressure on the male members 123, discharges or disengages the male members 123 from the female members 124. It should be understood that the docking tool 150 may have any number of pin release docks 152 and is not limited to number of docks as disclosed herein.

The above-described individual components of the first strain relief assembly 22 and the second strain relief assembly 24 thus each have a measure of relative movement within the respective strain relief assembly. The individual components may be fabricated from a flexible plastic or rubber material, such as PVC and thermoplastic rubber. This measure of movement allows for a 360-degree spin within a ball joint, but limit side-to-side and up-and-down movements within the ball joint. This configuration provides the innovative and advantageous strain relief function by preventing the enclosed electrical cable 16 from flexing more than about 45 degrees to about 65 degrees.

The above disclosure may be used with any existing electrical cabling with one or more connectors. Each of the connectors may be used with multiple colors or shape or material or with various properties. For example, the disclosure may be implemented with USB cable, cell phone charger, ear-phone cable and so on. It must be understood that the above examples are presented for illustrative purposes only and should not be construed to be limited to these specific examples. Further, the position and number of the pins and the sockets may be provided depending on the need or the material used for connectors.

In the preceding specification, the present disclosure is described with reference to the specific embodiments. However, it will be apparent to a person with ordinary skill in the art that various modifications and changes can be made, without departing from the scope of the present disclosure. Accordingly, the specification and figures are to be regarded as illustrative examples of the present disclosure, rather than in restrictive sense. All such possible modifications are intended to be included within the scope of present disclosure.

What is claimed is:

1. A connector strain relief assembly suitable for placement over a junction of an electrical cable and an attached electrical connector, the strain relief assembly comprising:

a connector adapter having (i) a first connector adapter end configured to fit over the electrical connector and (ii) a second connector adapter end, a portion of a surface of the second connector adapter end having a substantially spherical shape;

a cable adapter having (i) a first cable adapter end configured to fit over the electrical cable, and (ii) a second cable adapter end, a portion of a surface of the second cable adapter end having a substantially spherical shape; and a ball-joint connector having a ball-joint link, wherein the ball-joint link includes a link ball end, wherein the link ball end is rotatably attached to the second connector adapter end, and a link socket end, wherein the link socket end is rotatably attached to the second cable adapter end, wherein each of the connector adapter, the cable adapter and the ball-joint connector comprises a first section and a second section, wherein the first section comprises pins and the second section comprises sockets, wherein the pins are allowed to mate with the sockets to join the first section and second section of each of the connector adapter, the cable adapter and the ball-joint connector.

2. The connector strain relief assembly of claim 1, wherein the second connector adapter end comprises a socket end, a portion of an inner surface of the socket end having a substantially spherical shape.

3. The connector strain relief assembly of claim 1, wherein the second connector adapter end comprises a ball end, a portion of an outer surface of the ball end having a substantially spherical shape.

4. The connector strain relief assembly of claim 1, wherein the second cable adapter end comprises a socket end, a portion of an inner surface of the socket end having a substantially spherical shape.

5. The connector strain relief assembly of claim 1, wherein the second cable adapter end comprises a ball end, a portion of an outer surface of the ball end having a substantially spherical shape.

6. The connector strain relief assembly of claim 1, wherein a portion of an outer surface of the link ball end comprises a substantially spherical shape.

7. The connector strain relief assembly of claim 1, wherein a portion of an inner surface of the link socket end comprises a substantially spherical shape.

8. The connector strain relief assembly of claim 1, wherein the connector strain relief assembly comprises a hollow configuration so as to allow the electrical cable to extend from the first cable adapter end to the electrical connector.

9. The connector strain relief assembly of claim 1 further comprises a docking tool to disengage the pins within the sockets.

10. The connector strain relief assembly of claim 9, wherein the docking tool comprises pin release docks.

11. A method of providing strain relief for a junction of an electrical cable and an electrical connector, the method comprising the steps of:

placing a cable adapter comprising a first cable adapter section and a second adapter section over the electrical cable, wherein the first cable adapter section comprising pins are mated with the second cable adapter section comprising sockets to join the first cable adapter section and the second cable adapter section, wherein the cable adapter comprises a socket end in contact with the electrical cable and a link ball end facing the junction;

placing a ball-joint connector comprising a first ball-joint connector section and a second ball-joint connector section over the electrical cable, wherein the first ball-joint connector section comprising pins are mated with the second ball-joint connector section comprising sockets to join the first ball-joint connector section and the second ball-joint connector section by snapping mechanism, wherein the ball-joint connector is rotatably attached from a link ball end of the ball-joint connector to the link ball end of the cable adapter;

placing a connector adapter having a connector end and a link ball end over the electrical cable, wherein the connector adapter comprises a first connector adapter section and a second connector adapter section, wherein the first connector adapter section comprising pins are mated with the second connector adapter section comprising sockets to join the first connector adapter section and the connector adapter section by snapping mechanism, wherein the link ball end of the connector adapter is rotatably attached to a link socket end of the ball-joint connector; and attaching the electrical connector comprising the cable adapter, the ball-joint connector, and the connector adapter over the electrical cable by snapping the pins of the cable adapter, the ball-joint connector, and the connector adapter into the sockets on the cable adapter, the ball-joint connector, and the connector adapter, respectively.

* * * * *